US005307702A

United States Patent [19]

Spellman et al.

[11] Patent Number: 5,307,702

[45] Date of Patent: May 3, 1994

[54] ENGINE STARTER HAVING AN INTERNAL SHIELD

[75] Inventors: James A. Spellman, Noblesville; Norman E. Goodwin, Jr.; Ross A. Gresley, both of Anderson, all of Ind.

[73] Assignee: General Motors Corporation, Detroit, Mich.

[21] Appl. No.: 14,925

[22] Filed: Feb. 8, 1993

[51] Int. Cl.[5] ..... F02N 15/06

[52] U.S. Cl. ..... 74/7 E; 74/7 A; 310/88; 475/149; 475/331

[58] Field of Search ..... 74/7 R, 7 E, 7 A; 310/88; 475/149, 331

[56] References Cited

U.S. PATENT DOCUMENTS

| | | | |
|---|---|---|---|
| 4,270,411 | 6/1981 | Pengo et al. | 475/149 |
| 4,671,125 | 6/1987 | Yabunaka | 74/7 E |
| 4,680,979 | 7/1987 | Morishita et al. | 74/7 |
| 4,712,451 | 12/1987 | Morishita et al. | 74/801 |
| 4,776,225 | 10/1988 | Morishita et al. | 74/7 |
| 4,831,895 | 5/1989 | Tanaka et al. | 74/785 |
| 4,848,172 | 7/1989 | Morishita | 74/7 |
| 4,899,605 | 2/1990 | Tanaka | 74/7 |
| 5,195,389 | 3/1993 | Isozumi | 74/7 E |

*Primary Examiner*—Allan D. Herrmann
*Attorney, Agent, or Firm*—Creighton R. Meland

[57] ABSTRACT

An electric engine starter that has a motor frame and a planetary gear mechanism is provided with an internal shield that is operative to prevent brush dust from entering the planetary gear mechanism. The shield is formed of steel and has an outer annular flange that, prior to assembly to the starter, is located at an angle to a plane that is normal to the longitudinal axis of the shield. When the shield is assembled to the starter, it is compressed between the motor frame and a support for the ring gear of the planetary gear mechanism. During this compression, the flange is deflected to develop a spring force. This spring force causes a gasket interposed between the flange and the motor frame to tightly seal against the motor frame. This spring force further causes the shield to tightly engage the ring gear support.

8 Claims, 2 Drawing Sheets

ENGINE STARTER HAVING AN INTERNAL SHIELD

This invention relates to an electric engine starter that has an internal shield.

Electric engine starters that use a planetary gear mechanism for driving a pinion shaft from the armature shaft of an electric cranking motor are well known. In starters of this type, carbon brush dust from the carbon brushes of the electric cranking motor is developed during operation of the starter. If this brush dust enters the planetary gear mechanism, it will increase the frictional loss of the planetary gear mechanism.

It accordingly is an object of this invention to provide a shield for an electric engine starter that is located in the engine starter in such a position as to prevent brush dust from entering the planetary gear mechanism. In carrying this object forward, the shield is formed as an annular steel part that has an outer annular flange that, prior to assembly, is located at an angle to a plane that is normal to the longitudinal axis of the shield.

The shield is assembled to the starter such that the outer annular flange faces the frame of the cranking motor and an annular portion of the shield that is located inwardly of the flange faces a part of the planetary gear mechanism. Further, a gasket is interposed between the annular flange and the frame of the cranking motor. When the through bolts of the starter are tightened, the shield is compressed between the cranking motor frame and a ring gear supporting part of the planetary gear mechanism. The annular flange is bent to a position where it is parallel to a surface on the frame of the cranking motor. The bent annular flange acts as a spring which takes up the axial tolerance of the stack-up of parts of the starting motor. Further, the spring force developed by the bent flange causes the gasket to be tightly clamped between the annular flange of the shield and the frame of the cranking motor to provide a tight seal with the end of the motor frame. This spring force also causes the shield to tightly engage the ring gear part.

The shield performs several functions. Thus, the shield prevents carbon dust from entering the planetary gearing. The shield further prevents contaminants that enter the drive side housing of the starter from getting into the electric cranking motor and into the planetary gear mechanism. The shield also acts as a spring to take up the axial tolerance of the stack-up of parts of the starter.

IN THE DRAWINGS

Figure 1:
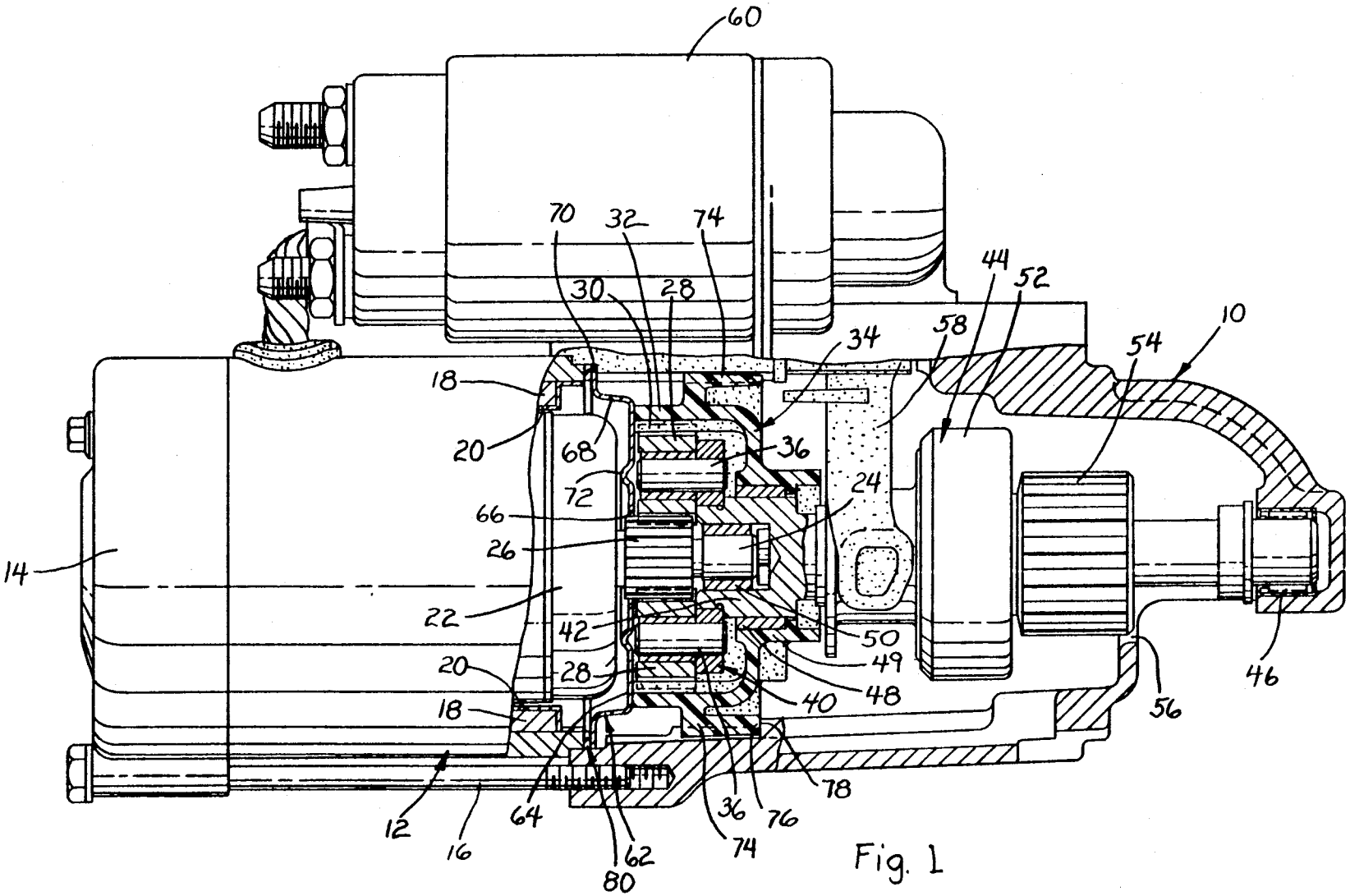
FIG. 1 is a side view, partly in section, of an engine starter that has a shield made in accordance with this invention.

Referring now to the drawings and more particularly to FIG. I, an electric engine starter is illustrated that has a shield made in accordance with this invention. This engine starter has a metallic drive housing 10, a tubular electric motor frame 12 and a commutator end cover or housing 14 . These parts are secured together by a plurality of through bolts, one of which is illustrated in FIG. 1 and identified as 16. The ends of through bolts 16 are threaded into threaded openings formed in drive housing 10 and the heads of these bolts engage cover 14.

The motor frame 12 is formed of a magnetic material such as steel and it supports a plurality of circumferentially spaced permanent magnets 18. The permanent magnets 18 are carried by a magnet retainer 20 that is welded to frame 12. The permanent magnets develop field flux for the electric cranking motor.

The electric cranking motor has an armature 22 that has an armature shaft 24. The left end (not illustrated) of the armature shaft 24 is journalled for rotation in a bearing (not illustrated) that is carried by cap or cover 14.

The commutator for armature 22 is located in cover 14 as are the carbon brushes that engage the commutator. The commutator is connected to the armature conductors of the armature.

The armature shaft 24 is connected to and drives a spur gear 26 which is the sun gear of a planetary gear set or mechanism. The gear 26 meshes with a plurality of planet gears each designated as 28. The planet gears 28 also mesh with a ring gear 30 that is comprised of a plurality of circumferentially spaced ring gear teeth located inside of and integral with an annular portion 32 of a one-piece ring gear support and housing part 34 that is formed of plastic material. Each planet gear 28 is journalled for rotation on a pin 36. The pins 36 are fixed to a plate 40 and the plate 40 is secured to a portion 42 of a pinion drive shaft 44. One end of shaft 44 is journalled for rotation in a bearing 46 carried by drive housing 10. The portion 42 of shaft 44 rotates in a sleeve bearing 48 carried by a portion 49 of plastic gear support and housing 34. The portion 42 of shaft 44 has a bore and a sleeve bearing 50 is positioned between a circular inner wall of the bore and armature shaft 24.

The pinion drive shaft 44 carries an overrunning clutch 52 and a pinion gear 54 that is moved into and out of mesh with the ring gear of an engine to be cranked. The housing 10 has an opening 56 which allows the pinion 54 to be moved into mesh with the ring gear of an engine. The clutch 52 transmits motion between shaft 44 and pinion gear 54 in a manner well known to those skilled in the art.

The clutch 52 and pinion 54 can be moved axially relative to shaft 44 by a shift lever 58 that can pivot in a known manner. The shift lever 58 is moved by the plunger (not illustrated) of a solenoid 60. The shift lever 58 pivots counter-clockwise in FIG. I to move the pinion gear 54 into mesh with the ring gear of the engine and pivots clockwise to pull the pinion gear 54 out of mesh with the ring gear.

The engine starter shown in FIG. I has an internal shield which is generally designated as 62. This shield 62 is formed of AISI 1008 steel and may have a thickness of about 0.021 inches.

Figure 4:
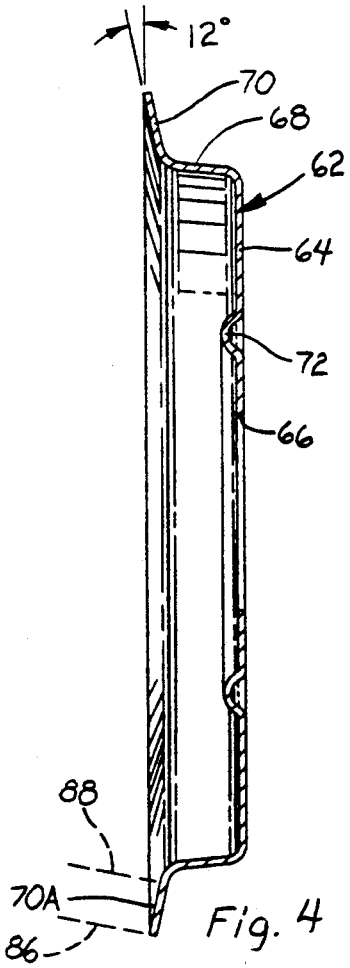
FIG. 4 is a sectional view of the shield shown in FIG. 3.

The shield 62 has an annular end wall 64 and a central hole or opening 66. The shield further has an axially extending annular portion 68 and an annular flange 70. The flange 70, as shown in FIG. 4, is located at an angle of twelve degrees relative to a plane that is normal to the longitudinal axis of shield 62. The shield 62 has an annular stiffening rib 72. The shield 62 is entirely imperforate except for central opening 66.

The ring gear support and housing part 34 has a plurality of axially extending and circumferentially spaced ribs 74 that fit into slots or grooves formed in housing 10. This fixes the part 34 from rotation relative to housing 10. The housing 10 has a plurality of circumferentially spaced ledge surfaces 76 that engage circumferentially spaced surfaces 78 on gear support part 34.

The manner in which shield 62 is assembled to the engine starter will now be described. The shield 62 and an annular gasket 80 are positioned generally, as shown in FIG. I, prior to the time that motor frame 12 is assembled to drive housing 10. The gasket 80 is formed of cellulose or cork material. The flange 70 of shield 62 is now in the twelve degree position shown in FIG. 4.

Figure 2:
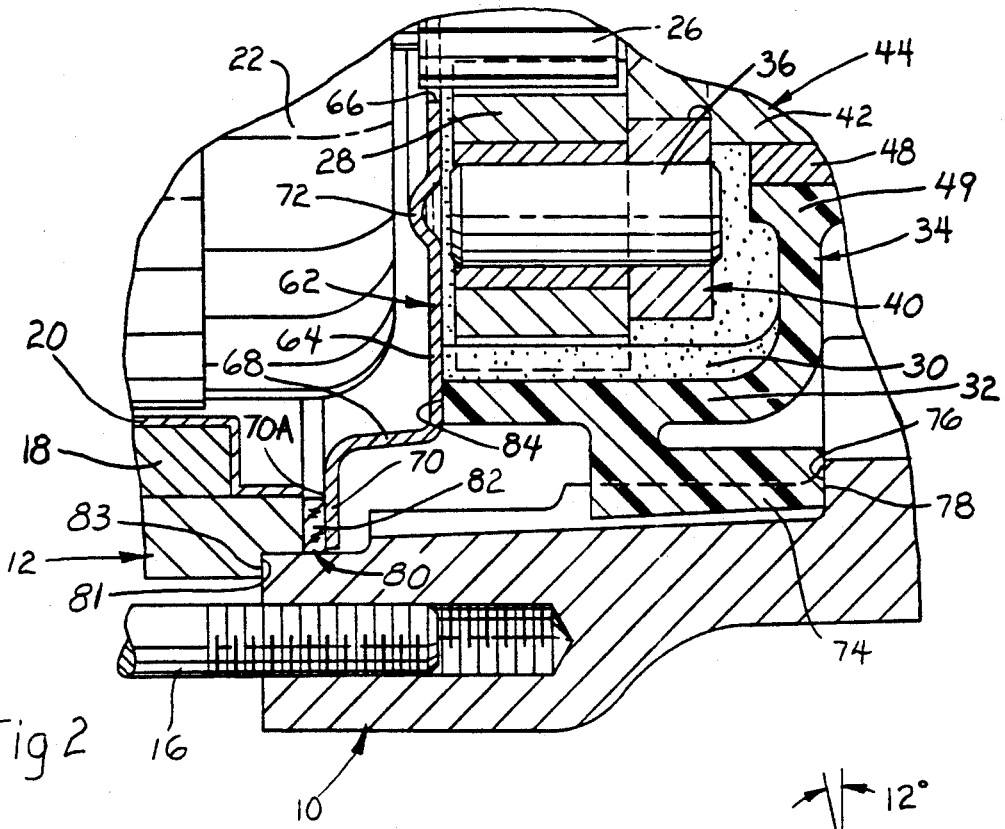
FIG. 2 is an enlarged sectional view of a portion of the starter shown in FIG. 1.
Figure 3:
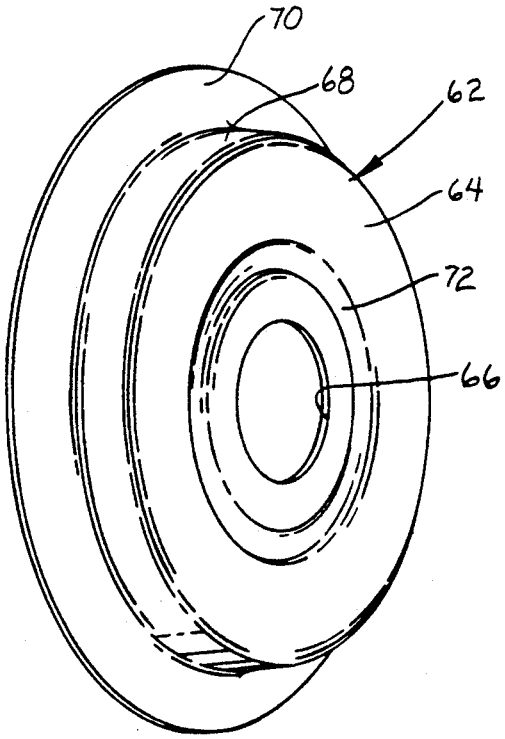
FIG. 3 is a perspective view of a shield made in accordance with this invention.

When frame 12 and housing 14 are now assembled to the drive housing, the through bolts 16 are tightened to move the surface 81 on frame 12 into tight engagement with the surface 83 on drive housing 10. As the through bolts 16 are tightened, the shield 62 and the gasket 80 are compressed between the annular surface 82 on frame 12 and annular surface 84 on gear part 34. In this regard, it can be seen that one side of gasket 80 engages surface 82 of frame 12 and that an annular surface portion of wall 64 of shield 62 engages the annular surface 84 of gear part 34. As the through bolts 62 are tightened, the flange 70 is bent or deflected from its twelve degree position, shown in FIG. 4, to a position where it is substantially parallel to wall 64 of shield 62 as shown in FIGS. 1 and 2. The bending or deflection of flange 70 permits axial take up of the axial tolerance of the stack-up of parts of the starter.

The flange 70 when deflected, operates as a spring or in other words, develops a spring force. This spring force tends to compress the gear part 34 between the shield 62 and the surfaces 76 on drive housing 10. Putting it another way, this spring force tends to maintain gear part 34 tightly engaged with drive housing 10.

The spring force developed by deflected flange 70 also tightly compresses the gasket 80 between frame 12 and flange 70 to provide a tight seal with the frame 12.

In the assembled position of shield 62, it can be seen from FIG. 1 that the inner cylindrical surface defining the central opening 66 in shield 62 is close to the outer periphery of gear 26.

The gasket 80 and shield 62 have been described as being separate parts. However, the gasket can be provided by coating the flange 70 with a material that adheres or is bonded to flange 70 and which operates as a gasket or seal. One type of material that is suitable for this purpose is a gasket enamel produced by Lilly Industrial Coatings, Inc. and identified as 91602-7185A black liquid gasket enamel. This gasket enamel can be painted onto annular surface or face 70A of flange 70 over a complete annular area that extends radially from dotted line 86 to dotted line 88. The painted on material adheres to flange 70 and it performs the same sealing function as separate gasket 80.

The brushes and commutator of the cranking motor, as previously described, are located in housing 14. As the brushes wear, carbon brush dust is developed which can move through the motor frame 12 toward the planetary gearing. The planetary gearing is shielded from this brush dust by the shield 62 and the gear support and housing part 34. Thus, the part 34 has a cup-shaped portion and the open end of the cup-shaped portion is completely closed by shield 62 except for opening 66. The spring force developed by bent flange 70 maintains the shield 62 in tight sealing engagement with the annular surface 84 of part 34.

The shield 62 and part 34 also serve to prevent contaminants, such as water, that enter drive housing 10 through opening 56, from entering the planetary gearing area.

The shield 62 also prevents contaminants, such as water, that may enter drive housing 10 through opening 56, from passing into frame 12 and into housing 14. In this regard, the gasket 80 provides a tight seal that will now allow contaminants to enter frame 12 from the interior of drive housing 10.

We claim: The embodiments of the invention in which an exclusive property or privilege is claimed are defined as follows:

1. An electric engine starter comprising, an electric cranking motor having a frame, said cranking motor having an armature and an armature shaft connected to said armature, a drive housing secured to said frame, a pinion drive shaft disposed within said drive housing, a planetary gear mechanism connected between said armature shaft and said pinion drive shaft, said planetary gear mechanism having a ring gear that is supported by a ring gear support, said ring gear support carried by said drive housing, a shield disposed between said frame and said planetary gear mechanism, said shield having a radially and circumferentially extending wall portion which engages said ring gear support and having an outer imperforate annular flange that faces a surface of said frame, and a gasket disposed between and engaging said surface, and said annular flange, said annular flange being deflected to a position where it develops a spring force when said frame is secured to said drive housing, said spring force operative to force said gasket tightly against said frame and operative to maintain said shield tightly engaged with said ring gear support.

2. The electric engine starter according to claim 1 where said shield has a central opening and where a sun gear of said planetary gear mechanism is connected to the armature shaft and where said sun gear is located in said central opening.

3. The electric engine starter according to claim 1 where said gasket is a gasket material that is bonded to said flange of said shield.

4. The electric engine starter according to claim 1 where said ring gear support has a cup-shaped portion, said shield being positioned to close a least portion of the open end of said cup-shaped portion.

5. The electric engine starter according to claim 1 where said shield is formed of steel.

6. A metallic shield that is adapted to be assembled to an electric engine starter with the shield compressed between a motor frame of the starter and ring gear support of a planetary gear mechanism of the starter comprising, a radially extending annular wall, an annular and axially extending wall extending axially from said radially extending annular wall, and an outer imperforate annular flange extending from said annular and axially extending wall, said flange being positioned at an angle to a plane that is normal to the longitudinal axis of said shield, said flange being adapted to be deflected to develop a spring force when said shield is assembled to said engine starter.

7. The shield according to claim 6 where the shield is formed of steel.

8. The shield according to claim 6 where the shield has a central opening that is adapted to receive a spur gear of the planetary gear mechanism.

* * * * *